US007140896B2

(12) United States Patent
Takai et al.

(10) Patent No.: US 7,140,896 B2
(45) Date of Patent: Nov. 28, 2006

(54) CONNECTOR

(75) Inventors: Masatake Takai, Koto-ku (JP); Takeki Fukazawa, Koto-ku (JP); Takanobu Yoshimi, Koto-ku (JP)

(73) Assignee: DDK, Ltd., Tokyo (JP)

( * ) Notice: Subject to any disclaimer, the term of this patent is extended or adjusted under 35 U.S.C. 154(b) by 0 days.

(21) Appl. No.: 11/233,678

(22) Filed: Sep. 23, 2005

(65) Prior Publication Data

US 2006/0089036 A1 Apr. 27, 2006

(30) Foreign Application Priority Data

Oct. 22, 2004 (JP) ..... 2004-307793
Jun. 6, 2005 (JP) ..... 2005-165317

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 5,906,498 A * 5/1999 Nagafuji ..... 439/260
6,726,497 B1 * 4/2004 Nogawa et al. ..... 439/260
6,855,002 B1 * 2/2005 Chiu ..... 439/495
6,997,729 B1 * 2/2006 Sunaga ..... 439/260
2004/0023551 A1 * 2/2004 Suzuki et al. ..... 439/495
2005/0255732 A1 * 11/2005 Sunaga ..... 439/260

FOREIGN PATENT DOCUMENTS

JP H6-82783/1994 3/1994
JP H11-307198/1999 11/1999
JP 2003-297489 10/2003
JP 2004-71160 3/2004
JP 2003-422258 8/2004

* cited by examiner

*Primary Examiner*—Gary F. Paumen
(74) *Attorney, Agent, or Firm*—Baker Botts, LLP

(57) ABSTRACT

A connector includes a required number of contacts, a housing, and a pivoting member. The contacts are substantially H-shaped and each includes at least a contact portion, a connection portion, a fulcrum portion, a connecting portion and a pressure receiving portion. The urging portions of the pivoting member are pivotally moved between the connection portions and the pressure receiving portions to bring the contact portions of the contacts into contact with a connecting object. The housing has a ceiling portion covering the contact portions of the contacts, and an upper wall covering the pressure receiving portions. The pivoting member includes an actuating portion, the urging portions, anchoring holes, and a cover portion for covering tail portions of the contacts upon pivotal movement of the pivoting member. The connecting object can be inserted into the connector with a slight force and dust proofing property can be improved.

26 Claims, 7 Drawing Sheets

CONNECTOR

CROSS-REFERENCE TO RELATED APPLICATIONS

This application claims priority from Japanese Patent Application No. 2004-307,793, filed Oct. 22, 2004 and Japanese Patent Application No. 2005-165,317, filed Jun. 6, 2005, which are herein incorporated by reference in their entirety.

BACKGROUND OF THE INVENTION

This invention relates to a connector using a flexible printed circuit board for use in electric or electronic appliances such as thin type plasma displays or televisions, notebook personal computers and the like, and more particularly to a dust-proof connector.

In general, connectors for use in mobile phones, charge coupled device (CCD) cameras and the like are much thinner and having contacts arranged in extremely narrow pitches (so-called lighter and more compact connector). A connector of one type mainly comprises a housing and contacts, and a flexible printed circuit board is inserted into the housing to bring the circuit board into contact with contact portions of the contacts (so-called "non-zero-insertion force (NZIF)" type). Moreover, another type connector mainly comprises a housing, contacts and a slider so that a flexible printed circuit board is embraced between the housing and the slider (so-called "zero-insertion force (ZIF)" type and "piano touch" type). Various methods may be envisioned for holding a flexible printed circuit board by means of the housing and the slider. In many cases, there have been constructions in which after a flexible printed circuit board has been inserted into a housing, a slider is inserted into the housing so that the circuit board is pressed against the contacts. Moreover, depending upon customer's demands or specifications and in the case that narrower pitches of contacts are desired, it may be unavoidable that connection portions of contacts should be located on the side of a fitting opening of a housing into which a flexible printed circuit board is inserted.

A housing may be usually formed with a required number of inserting holes for inserting contacts and a fitting opening into which a flexible printed circuit board is inserted.

In general, contacts each comprise a contact portion adapted to contact a flexible printed circuit board, a connection portion to be connected to a substrate or the like, and a fixed portion to be fixed to the housing. These contacts may be fixed to the housing as by press-fitting.

Exemplarily described in the following passages are "Patent Literature 1" (Japanese Patent Application Opened No. 2003-297,489), "Patent Literature 2" (Japanese Patent Application Opened No. H11-307,198/1999) and "Patent Literature 3" (Japanese Patent Application Opened No. 2004-71,160) filed by the applicant of the present application, as examples of a so-called "back lock type" of the ZIF type. Moreover, further exemplarily described are "Patent Literature 4" (Japanese Utility Model Application Opened No. H6-82,783/1994) and "Patent Literature 5" (Japanese Patent Application No. 2003-422,258) proposed and filed by the applicant of the present case, as examples of the construction adapted to lock a flexible printed circuit board.

"Patent Literature 1"

According to the ABSTRACK of the Japanese Patent Application Opened No. 2003-297,489, the object of the invention is to provide a connector having an actuator operated by a slight operating force and increasing the movement of contacts to ensure the reliable connection, and achieving miniaturization in height or reduced overall height of the connector. The actuator includes cam portions and an operating portion and is formed with undercuts between the cam portions and the operating portion, into and from which front ends of spring portions of the contacts are able to be inserted and removed. When the actuator is pivotally moved clockwise 90 degrees about a fulcrum, the cam portions cause the spring portions of the contacts and connecting springs to be elastically deformed to embrace a flexible printed circuit board between protrusions of contact portions of the contacts so that patterns of the flexible printed circuit board are connected through terminal portions of the contacts to a printed substrate. An insulator has a ceiling portion covering the contact portions of the contacts, and a guide formed below the front end of the ceiling portion for inserting the flexible printed circuit board into the connector.

"Patent Literature 2"

According to the ABSTRACT of the Japanese Patent Application Opened No. H11-307,198/1999, the invention has an object to provide a connector connecting a plurality of terminals and holding a flexible printed circuit board, which is superior in operationality and holding faculty for a printed circuit board. The connector for a printed circuit board comprises a housing having an inserting groove for a flexible printed circuit board or the like, a plurality of contacts arranged in a line so that contact portions of the contacts extend into and retract from the inserting groove, and an operating member provided pivotally movable between a connecting position and a disconnecting position and provided with a plurality of cams. When the operating member is in the connecting position, the contacts are urged with their operated portions by means of the cams so as to extend their contact portions into the inserting groove to press the terminals of the flexible printed circuit board, thereby connecting the contacts to the terminals and holding the circuit board. On the other hand, when the operating member is in the disconnecting position, the some contacts are urged with their operated portions by means of the cams so as to slightly extend their contact portions into the inserting groove to abut against the flexible printed circuit board, thereby temporarily holding the circuit board, and the remaining contacts are retracted with their contact portions from the inserting groove.

"Patent Literature 3"

According to the ABSTRACT of the Japanese Patent Application Opened No. 2004-71,160, the object of the invention is to provide a connector which is able to cause a flexible printed circuit board or flexible flat cable to be securely pressed against contact portions of contacts by means of a slider without the strength and specifications of respective parts being degraded, and is capable of achieving narrower pitches and miniaturization in height or reduced overall height of connector with superior operationality. The contacts each comprise a contact portion, a connection portion, an elastic portion and a fulcrum portion between the contact portion and the connection portion, and a pressure receiving portion extending from the elastic portion and located in a position opposite or facing to the connection portion. The contact portion, the elastic portion, the fulcrum portion and the connection portion are arranged substantially in the form of a crank. The slider is provided with urging portions continuously arranged in its longitudinal direction and is pivotally movably mounted on a housing so that the urging portions are pivotally moved between the connection portions and the pressure receiving portions of the contacts.

"Patent Literature 4"

According to the ABSTRACT of the Japanese Utility Model Application Opened No. H6-82,783/1994, this utility model has an object to provide a connector provided with a slider having claws capable of anchoring even flat cables reinforced by a rigid reinforcing plate attached to the rear side of the flat cables. In the connector including a housing having contact pins therein and formed with a fitting space into which flat cables are inserted, and a slider adapted to be inserted into and removed from the fitting space and mounted on the housing to be pivotally movable outside the housing when the slider is removed therefrom, and the slider being forced into the fitting space after the flat cables have been inserted into the fitting space so that the flat cables are electrically connected to the contact pins, the slider is provided on its flat cable abutting surface with anchoring protrusions adapted to be inserted and anchored in anchoring portions formed in both the flat cables and the reinforcing plate attached to rear faces of the flat cables.

"Patent Literature 5"

Japanese Patent Application No. 2003-422,258 was proposed and filed by the applicant of the present case as a connector capable of locking a flexible printed circuit board. This invention has an object to provide a connector achieving a required holding force for a flexible printed circuit board without any defective or failed connection even if the number of contacts is minimal. In the connector into which a flexible printed circuit board is detachably inserted, including a required number of contacts having a contact portion to contact a flexible printed circuit board, and a housing holding and fixing the contacts therein and having a fitting opening into which the flexible printed circuit board is inserted, the flexible printed circuit board is provided with anchoring portions, and locking members having an engaging portion engaging the anchoring portion are mounted on the housing so that the engaging portions of the locking members are caused to engage the anchoring portions of the flexible printed circuit board, thereby preventing the circuit board from being dislodged from the housing, and further grooves are provided at locations corresponding to the engaging portions to ensure more reliable locking of the locking members.

On proceeding of miniaturization of electric and electronic appliances in recent years, the requirement for miniaturization has put more severe pressure on connectors to be used in such appliances, with the result that the connectors have also been further miniaturized. With such a miniaturization of the connectors, it has been publicly effected to expose upper surfaces of contacts (particularly on the tail side of the contacts) in order to acquire a space sufficient to operate a pivoting member such as an actuator or slider. However, the exposure of the contacts may detract from the dust proofing property even in the case that the miniaturization of connector is not required depending upon its intended use. The deterioration in dust proofing property may lead to failed or defective connection.

It is also required to insert a flexible printed circuit board into a connector with a slight force as far as possible. It is further required to visually ascertain whether a flexible printed circuit board has been completely fitted in a connector.

SUMMARY OF THE INVENTION

It is an object of the invention to provide a connector which overcomes the disadvantages of the prior art described above and which is able to insert a flexible printed circuit board with a slight force and further improves its dust proofing property.

The object described above will be accomplished by a connector 10 according to the invention detachably fitted with a connecting object such as a flexible printed circuit board 64, including a required number of contacts 14 having a contact portion 26 adapted to contact the connecting object, a housing 12 holding and fixing the contacts 14 and having a fitting opening 20 into which the connecting object is inserted, and a pivoting member 18 for urging the contacts 14, wherein the contacts 14 each comprises a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a fulcrum portion 28 at one end and a connection portion 40 at the other end adapted to be connected to a substrate; and a connecting portion 30 for connecting the first piece 22 and the fulcrum portion 28; and the contact portion 26, the connecting portion 30, the fulcrum portion 28 and the connection portion 40 are arranged substantially in the form of a crank, wherein the housing 12 comprises a ceiling portion 50 covering the contact portions 26 of the contacts 14, and an upper wall 52 covering the pressure receiving portions 32 of the contacts and provided contiguous to the ceiling portion 50, wherein the pivoting member 18 comprises an actuating portion 56 for pivotally moving the pivoting member, urging portions 54 provided continuously in its longitudinal direction, anchoring holes 58 independently from one another for receiving the pressure receiving portions 32 of the contacts and adapted to engage the projections 42, and a cover portion 60 for covering the tail portions of the contacts, and the pivoting member is so mounted on the housing 12 that the urging portions 54 are pivotally moved between the connection portions 40 and the pressure receiving portions 32 of the contacts 14, and wherein when the contacts 14 have been connected to the connecting object by pivotally moving the pivoting member 18, the tail portions of the contacts are covered by the cover portion 60 of the pivoting member 18.

If an even narrower pitch is desired, it is achieved by the connector 10 according to the invention detachably fitted with a connecting object such as a flexible printed circuit board 64, including a required number of contacts 14 and 16 having the contact portion 26 adapted to contact the connecting object, a housing 12 holding and fixing the contacts 14 and 16 and having a fitting opening 20 into which the connecting object is inserted, and a pivoting member 18 for urging the contacts 14 and 16, wherein the contacts comprise two kinds of contacts 14 and 16 arranged alternately staggered, the contacts 14 of one kind each comprising a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a fulcrum portion 28 at one end and a connection portion 40 at the other end adapted to be connected to a substrate; and a connecting portion 30 for connecting the first piece 22 and the fulcrum portion 28; and the contact portion 26, the connecting portion 30, the fulcrum portion 28 and the connection portion 40 are arranged substantially in the form of a crank, and the contacts 16 of the other kind each comprising a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a connection portion 40 at one end adapted to be connected to a substrate and a fulcrum portion 28 at the other end; and a connecting portion 30 for connecting the first piece 22 and the fulcrum portion 28; and the contact portion 26, the connecting portion 30, the fulcrum portion 28 and the connection portion 40 are arranged substantially in the form of a U-shape, wherein the housing 12 comprises a ceiling portion 50 covering the contact portions 26 of the contacts 14 and 16 of the one kind and the other kind, and an upper wall 52 covering the pressure receiving portions 32 of the contacts of both the kinds and provided contiguous to the ceiling portion 50, wherein the pivoting member 18 comprises an actuating portion 56 for pivotally moving the pivoting member, urging portions 54 provided continuously in its longitudinal direction, anchoring holes 58 independently from one another for receiving the pressure receiving portions 54 of the contacts and adapted to engage the projections 42, and a cover portion 60 for covering the tail portions of the contacts, wherein the tail portions include projections 42 of pressure receiving portions 32, the tails of extension portions 36 and vertical surfaces 41 of protrusion bases 44 extending from connection portions 40, and the pivoting member is so mounted on the housing 12 that the urging portions 54 are pivotally moved between the connection portions 40 and the pressure receiving portions 32 of the contacts 14 of the one kind or between the pressure receiving portions 32 of the contacts of the other kind and the housing 12, and wherein when the contacts 14 and 16 have been connected to the connecting object by pivotally moving the pivoting member 18, the tail portions of the contacts are covered by the cover portion 60 of the pivoting member 18.

According to the invention, the connecting object such as a flexible printed circuit board 64 is provided with anchoring portions 66, and the housing 12 is provided on both sides in its longitudinal direction with engaging portions 46 each adapted to engage the anchoring portion 66 of the connecting object. Moreover, the contacts 14 are each provided with an extension portion 36 extending from the fulcrum portion 28 in such a direction that the extension portion 36 faces to the contact portion 26, and further provided with an elastically displaceable contact piece 34 extending substantially in the form of an L-shape from the extension portion 36 in a position facing to the contact portion 26.

According to the invention, furthermore, the contacts 14 of the one kind are each provided with an extension portion 36 extending from the fulcrum portion 28 in such a direction that the extension portion 36 faces to the contact portion 26 and further provided with an elastically displaceable contact piece 34 extending from the extension portion 36 in a position facing to the contact portion 26, and the contacts 16 of the other kind are each provided with an extension portion 36 extending from the fulcrum portion 28 onto such a side that the extension portion 36 faces to the pressure receiving portion 32, and further provided with an elastically displaceable contact piece 34 extending substantially in the form of an L-shape in a position facing to the contact portion 26 between the fulcrum portion 28 and the connection portion 40.

According to the invention, the connection portions 40 of the contacts 14 and the contacts 16 of the one kind are each provided with a protrusion base 44 extending from the connection portion 40, and when the pivoting member 18 is pivotally moved, its urging portions 54 are pivotally moved between the pressure receiving portions 32 and the protrusion bases 44. Moreover, the pivoting member 18 is provided with a groove 62 for preventing the pivoting member from abutting against the upper wall 52 of the housing 12 when the pivoting member is pivotally moved relative to the housing.

According to the invention, moreover, the connecting object such as a flexible printed circuit board 64 is provided with projections or recesses as the anchoring portions 66, and the housing 12 is provided with recesses or projections as the engaging portions 46 adapted to engage the anchoring portions 66. Moreover, the upper wall 52 of the housing 72 and the actuating portion 56 of the pivoting member 78 are free from slits, grooves, recesses, notches and the like so as to be as flat as possible in order to enhance the dust proofing property.

As can be seen from the above description, the connector according to the invention can bring about the following significant effects.

(1) According to the invention, the connector 10 detachably fitted with a connecting object such as a flexible printed circuit board 64, includes a required number of contacts 14 having a contact portion 26 adapted to contact the connecting object, a housing 12 holding and fixing the contacts 14 and having a fitting opening 20 into which the connecting object is inserted, and a pivoting member 18 for urging the contacts 14, wherein the contacts 14 each comprises a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a fulcrum portion 28 at one end and a connection portion 40 at the other end adapted to be connected to a substrate; and a connecting portion 30 for connecting the first piece 22 and the fulcrum portion 28; and the contact portion 26, the connecting portion 30, the fulcrum portion 28 and the connection portion 40 are arranged substantially in the form of a crank, wherein the housing 12 comprises a ceiling portion 50 covering the contact portions 26 of the contacts 14, and an upper wall 52 covering the pressure receiving portions 32 of the contacts and provided contiguous to the ceiling portion 50, wherein the pivoting member 18 comprises an actuating portion 56 for pivotally moving the pivoting member, urging portions 54 provided continuously in its longitudinal direction, anchoring holes 58 independently from one another for receiving the pressure receiving portions 32 of the contacts and adapted to engage the projections 42, and a cover portion 60 for covering the tail portions of the contacts, and the pivoting member is so mounted on the housing 12 that the urging portions 54 are pivotally moved between the connection portions 40 and the pressure receiving portions 32 of the contacts 14, and wherein when the contacts 14 have been connected to the connecting object by pivotally moving the pivoting member 18, the tail portions of the contacts are covered by the cover portion 60 of the pivoting member 18. Therefore, a flexible printed circuit board 64 can be inserted into the connector 10 with a slight force, and upper surfaces of the contacts 14 are securely covered to improve the dust proofing property of the connector.

(2) According to the invention, the connector detachably fitted with a connecting object such as a flexible printed circuit board 64, includes a required number of contacts 14 and 16 having the contact portion 26 adapted to contact the connecting object, a housing 12 holding and fixing the contacts 14 and 16 and having a fitting opening 20 into which the connecting object is inserted, and a pivoting member 18 for urging the contacts 14 and 16, wherein the contacts comprise two kinds of contacts 14 and 16 arranged alternately staggered, the contacts 14 of one kind each comprising a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a fulcrum portion 28 at one end and a connection portion 40 at the other end adapted to be connected to a substrate; and a connecting portion 30 for connecting the first piece 22 and the fulcrum portion 28; and the contact portion 26, the connecting portion 30, the fulcrum portion 28 and the connection portion 40 are arranged substantially in the form of a crank, and the contacts 16 of the other kind each comprising a first piece 22 having the contact portion 26 at one end adapted to contact the connecting object, a pressure receiving portion 32 at the other end adapted to be urged by the pivoting member 18, and a projection 42 inwardly extending from the front end of the pressure receiving portion 32; a second piece 24 having a connection portion 40 at one end adapted to be connected to a substrate and a fulcrum portion 28 at the other end; and a connecting portion 30 for connecting the first piece 22 and the fulcrum portion 28; and the contact portion 26, the connecting portion 30, the fulcrum portion 28 and the connection portion 40 are arranged substantially in the form of a U-shape, wherein the housing 12 comprises a ceiling portion 50 covering the contact portions 26 of the contacts 14 and 16 of the one kind and the other kind, and an upper wall 52 covering the pressure receiving portions 32 of the contacts of both the kinds and provided contiguous to the ceiling portion 50, wherein the pivoting member 18 comprises an actuating portion 56 for pivotally moving the pivoting member, urging portions 54 provided continuously in its longitudinal direction, anchoring holes 58 independently from one another for receiving the pressure receiving portions 32 of the contacts and adapted to engage the projections 42, and a cover portion 60 for covering the tail portions of the contacts, and the pivoting member is so mounted on the housing 12 that the urging portions 54 are pivotally moved between the connection portions 40 and the pressure receiving portions 32 of the contacts 14 of the one kind or between the pressure receiving portions 32 of the contacts of the other kind and the housing 12, and wherein when the contacts 14 and 16 have been connected to the connecting object by pivotally moving the pivoting member 18, the tail portions of the contacts are covered by the cover portion 60 of the pivoting member 18. Therefore, according to the invention, even narrower pitches can be achieved, and the connector 10 is required only a slight force for inserting a flexible printed circuit board 64 thereinto and has a construction securely covering the upper surfaces of the contacts 14 and 16 to improve the dust proofing property of the connector 10.

(3) According to the invention, the connecting object such as a flexible printed circuit board 64 is provided with anchoring portions 66, and the housing 12 is provided on both sides in its longitudinal direction with engaging portions 46 each adapted to engage the anchoring portion 66 of the connecting object. Consequently, the connector 10 is capable of securely locking a flexible printed circuit board 64 to prevent tilted insertion of the circuit board 64 into the connector and makes it possible to visually ascertain the state of the circuit board 64 being inserted into the connector 10.

(4) According to the invention, the contacts 14 are each provided with an extension portion 36 extending from the fulcrum portion 28 in such a direction that the extension portion 36 faces to the contact portion 26, and further provided with an elastically displaceable contact piece 34 extending substantially in the form of an L-shape from the extension portion 36 in a position facing to the contact portion 26. Therefore, the connector 10 can accommodate a flexible printed circuit board 64 having contacts on its both surfaces, while lower portions of the contacts of the connector are also elastically displaceable so that stable electrical connection can be obtained.

(5) According to the invention, the contacts 14 of the one kind are each provided with an extension portion 36 extending from the fulcrum portion 28 in such a direction that the extension portion 36 faces to the contact portion 26 and further provided with an elastically displaceable contact piece 34 extending from the extension portion 36 in a position facing to the contact portion 26, and the contacts 16 of the other kind are each provided with an extension portion 36 extending from the fulcrum portion 28 onto such a side that the extension portion 36 faces to the pressure receiving portion 32, and further provided with an elastically displaceable contact piece 34 extending substantially in the form of an L-shape in a position facing to the contact portion 26 between the fulcrum portion 28 and the connection portion 40. Therefore, even narrow pitches can be achieved, and the connector can accommodate a flexible printed circuit board 64 having contacts on its both surfaces, while lower portions of the contacts are also elastically displaceable resulting in stable electrical connection.

(6) According to the invention, the connection portions 40 of the contacts 14 and the contacts 16 of the one kind are each provided with a protrusion base 44 extending from the connection portion 40, and when the pivoting member 18 is pivotally moved, its urging portions 54 are pivotally moved between the pressure receiving portions 32 and the protrusion bases 44. Accordingly, by changing the height of the protrusion base 44, the upper height of the urging portion 54 of the pivoting member 18 can be arbitrarily varied, thereby obtaining stable pivotal movement and stable electrical connection.

(7) According to the invention, the pivoting member 18 is provided with a groove 62 for preventing the pivoting member from abutting against the upper wall 52 of the housing 12 when the pivoting member is pivotally moved relative to the housing. Therefore, the tail portions of the contacts 14 and 16 can be securely covered by the pivoting member 18 to obtain reliable dust proofing property of the connector.

(8) According to the invention, the connecting object such as a flexible printed circuit board is provided with projections or recesses as the anchoring portions 66, and the housing 12 is provided with recesses or projections as the engaging portions 46 adapted to engage the anchoring portions 66. Consequently, the connector 10 is capable of securely locking a flexible printed circuit board 64 with a simple construction to prevent tilted insertion of the circuit board 64 into the connector and makes it possible to visually ascertain the state of the circuit board 64 being inserted into the connector 10.

(9) According to the invention, the upper wall 52 of the housing 72 and the actuating portion 56 of the pivoting member 78 are free from slits, grooves, recesses, notches and the like so as to be as flat as possible. Therefore, the dust proofing property of the connector 70 is further improved.

The invention will be more fully understood by referring to the following detailed specification and claims taken in connection with the appended drawings.

DESCRIPTION OF THE PREFERRED EMBODIMENTS

Figure 1A:
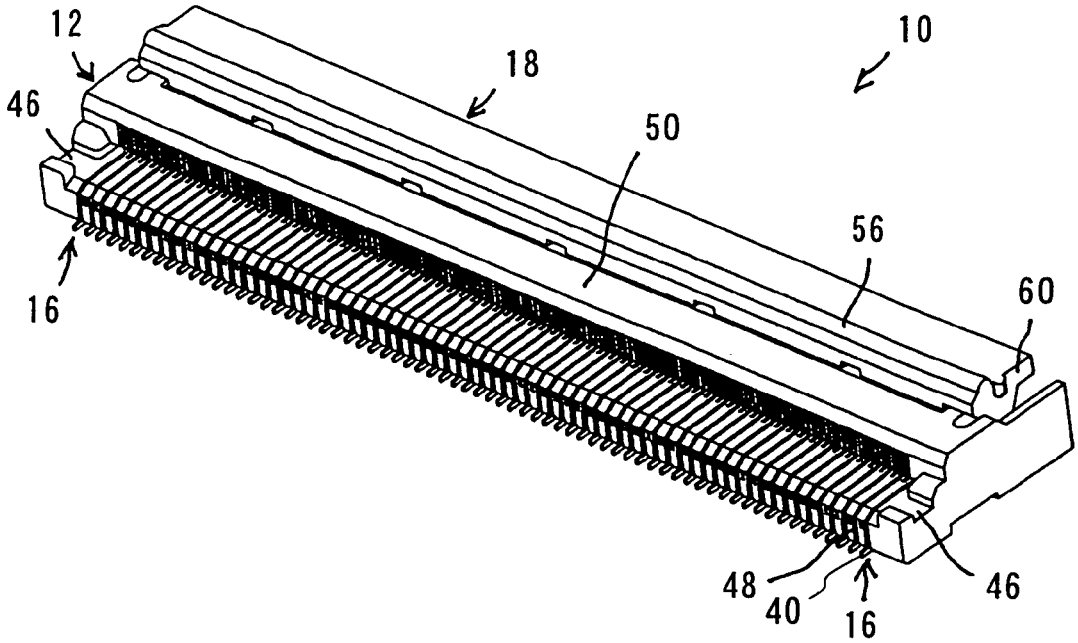
FIG. 1A is a perspective view of a connector according to the invention with a pivoting member opened, viewed from the side inserting a flexible printed circuit board.
Figure 1B:
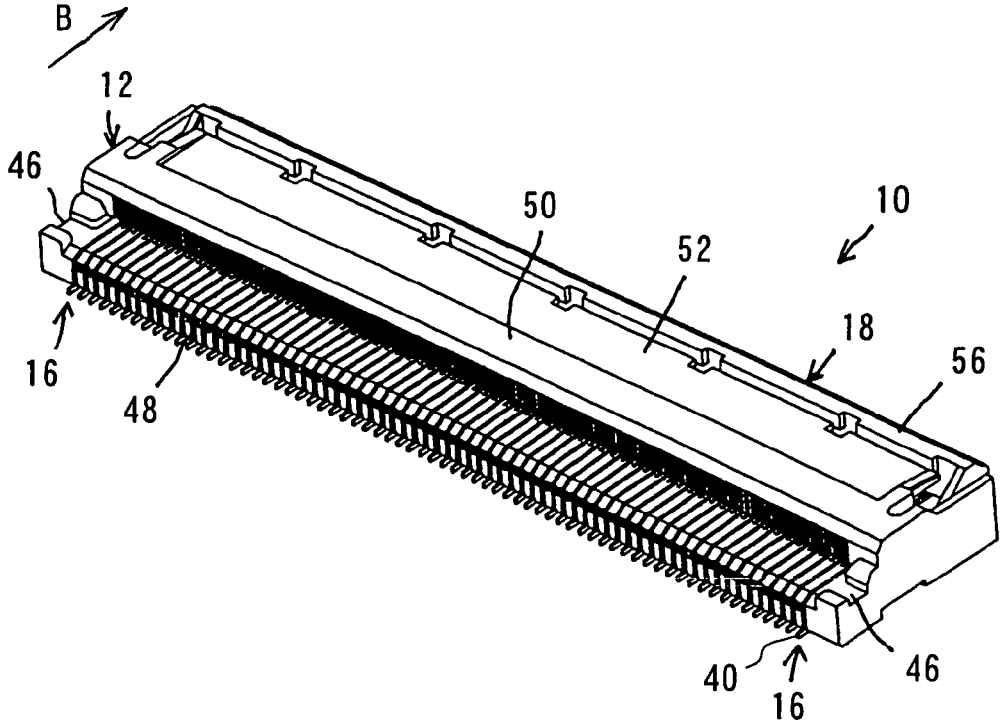
FIG. 1B is a perspective view similar to FIG. 1A but with the pivoting member closed.
Figure 2:
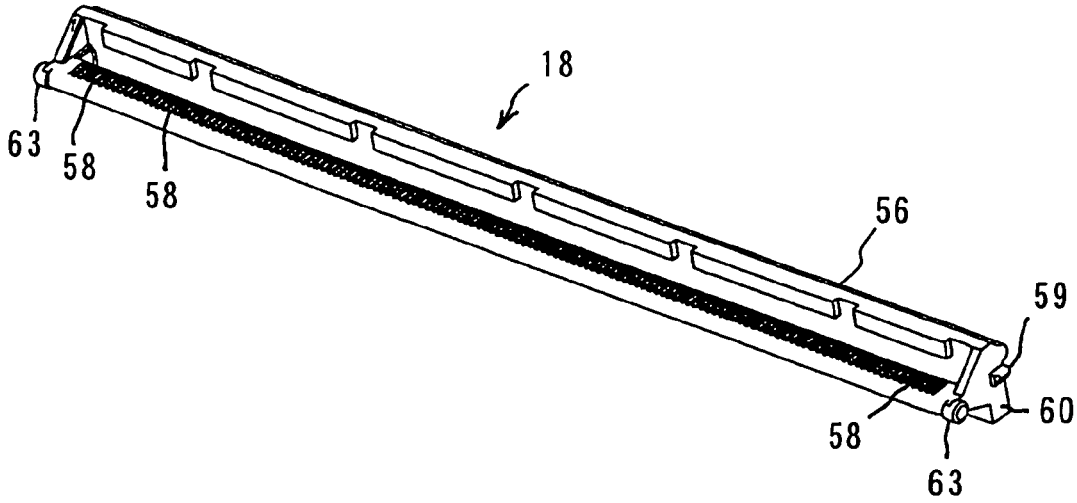
FIG. 2 is a perspective view of the pivoting member.
Figure 3:
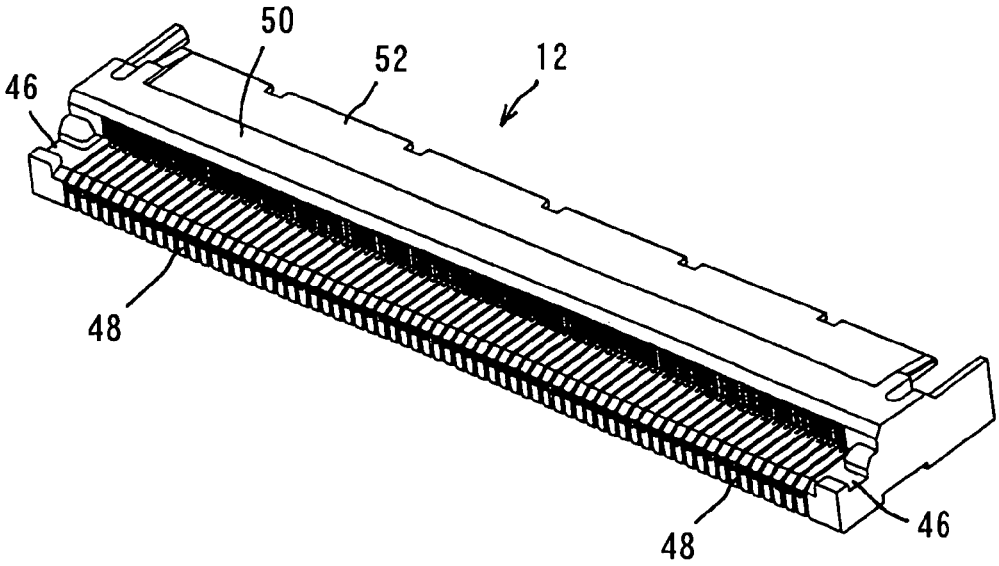
FIG. 3 is a perspective view of the housing of the connector shown in FIG. 1A.
Figure 4A:
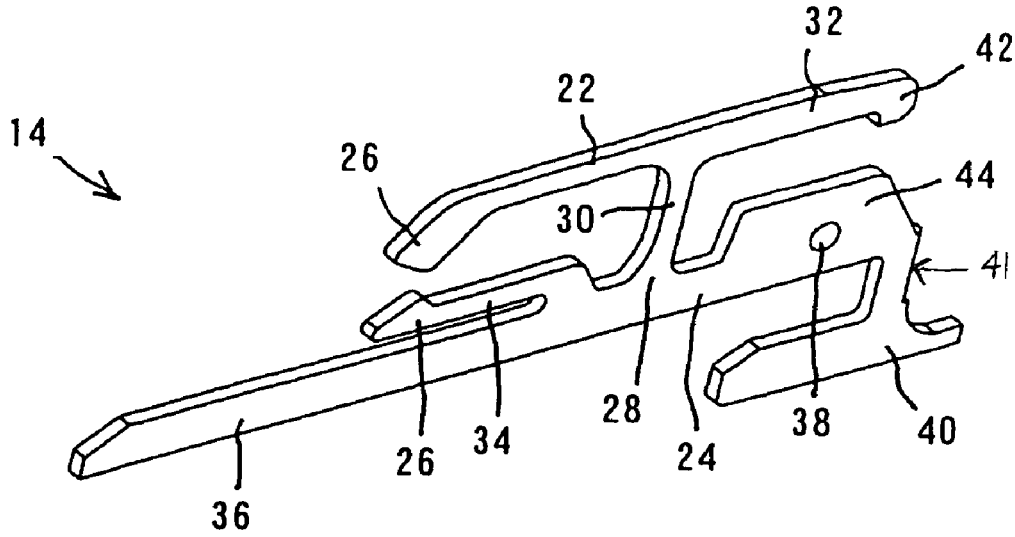
FIG. 4A is a perspective view of the contact of one kind used in the connector shown in FIG. 1A.
Figure 4B:
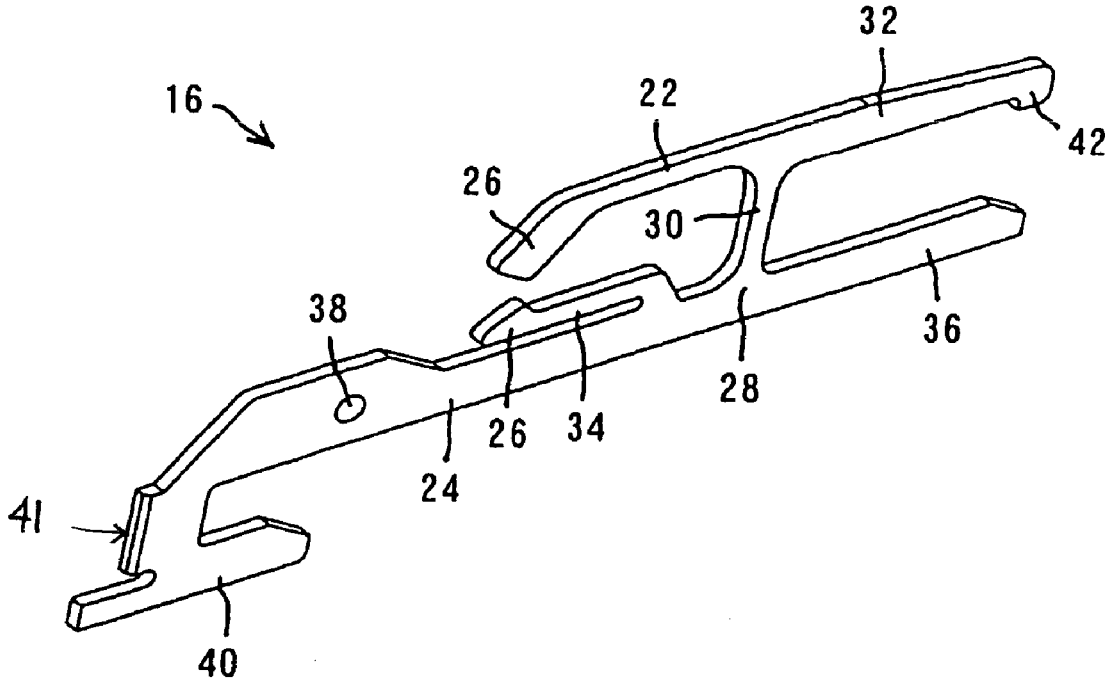
FIG. 4B is a perspective view of the contact of the other kind used in the connector shown in FIG. 1A.
Figure 5A:
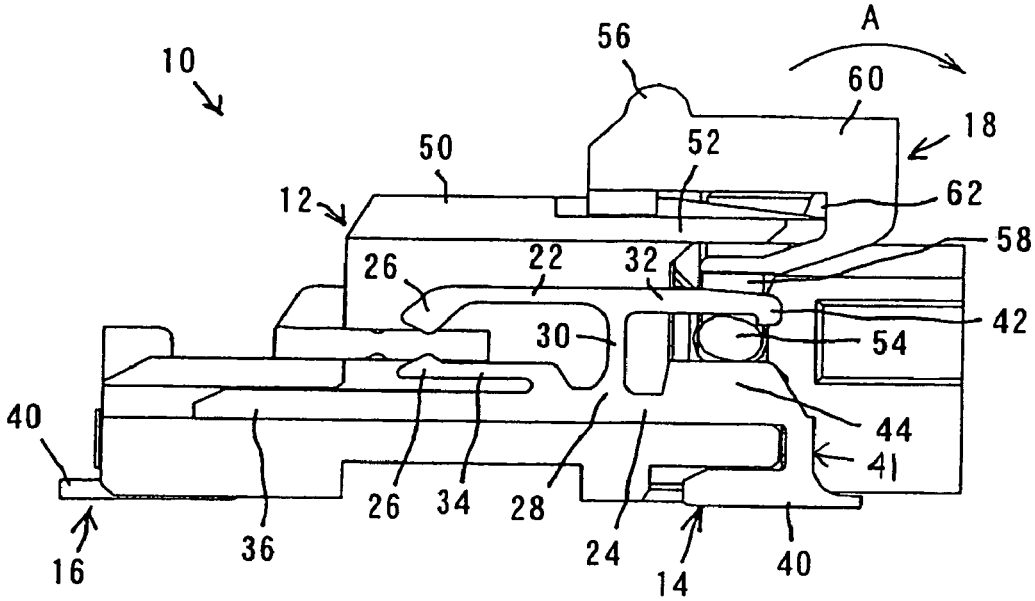
FIG. 5A is a sectional view of the connector taken along the contact of one kind, with the pivoting member opened.
Figure 5B:
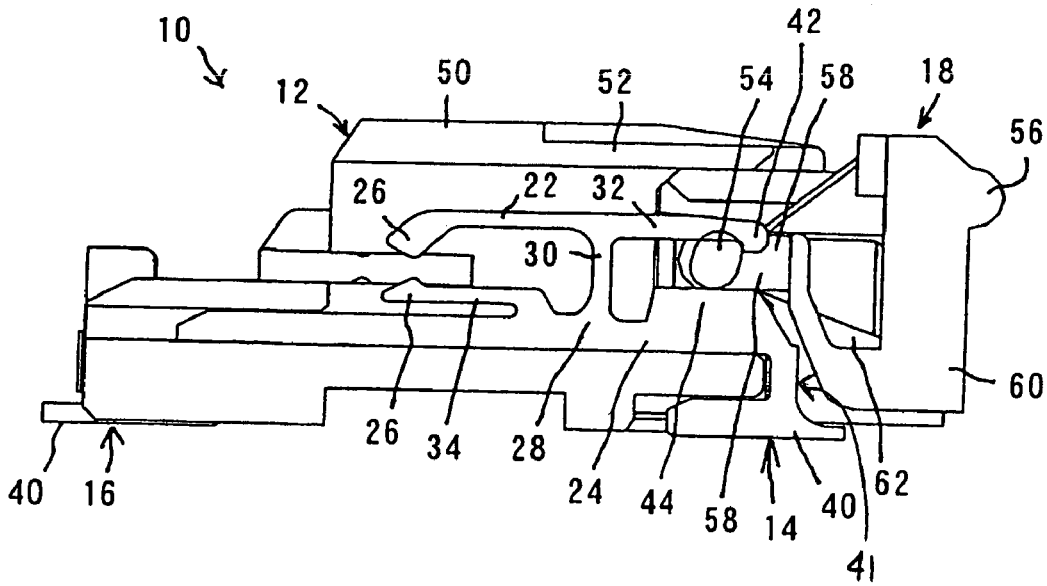
FIG. 5B is a sectional view of the connector taken along the contact of one kind, with the pivoting member closed.
Figure 6A:
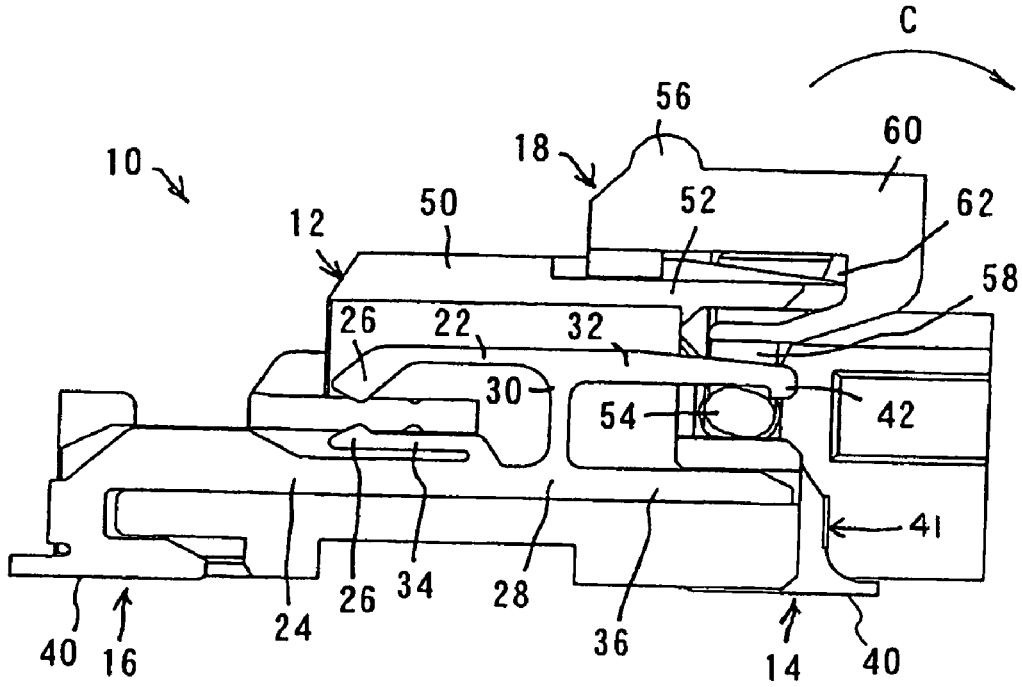
FIG. 6A is a sectional view of the connector taken along the contact of the other kind, with the pivoting member opened.
Figure 6B:
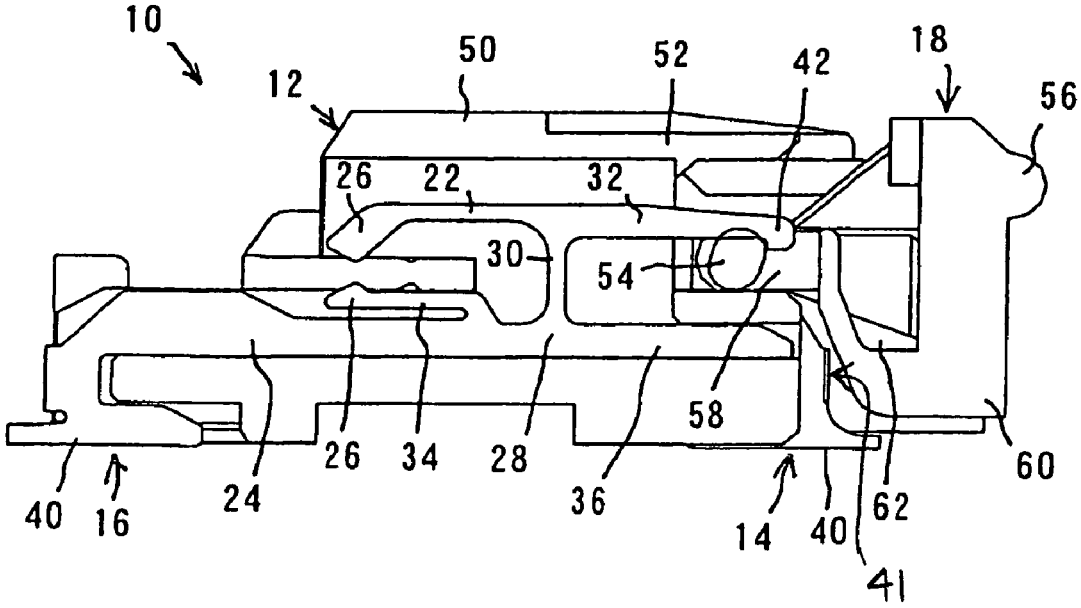
FIG. 6B is a sectional view of the connector taken along the contact of the other kind, with the pivoting member closed.
Figure 7A:
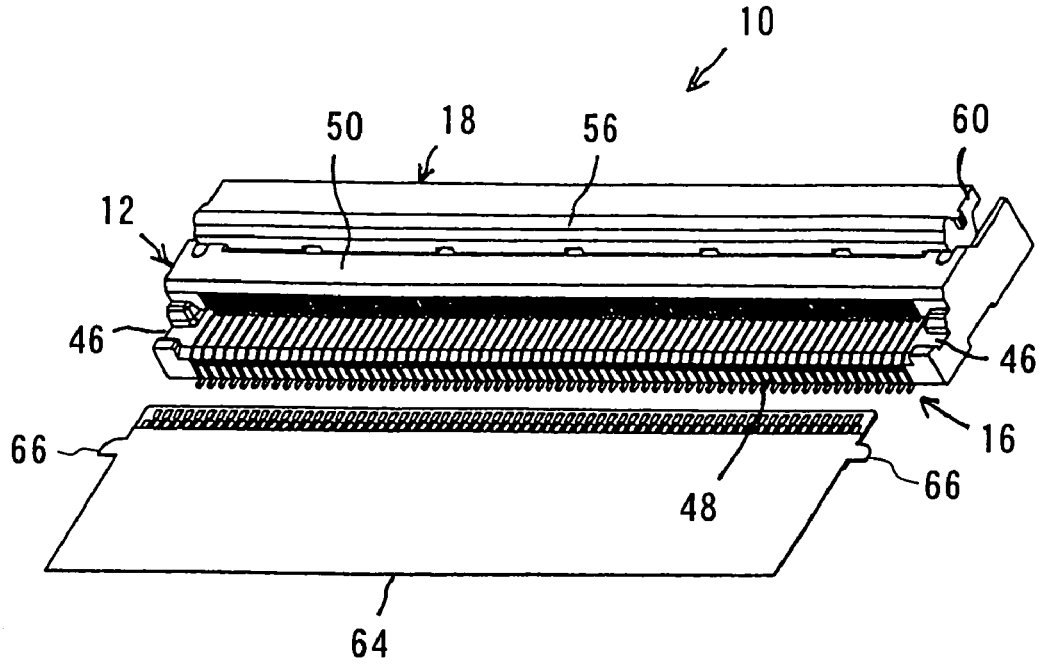
FIG. 7A is a perspective view of the connector and the flexible printed circuit board which is not yet inserted into the connector.
Figure 7B:
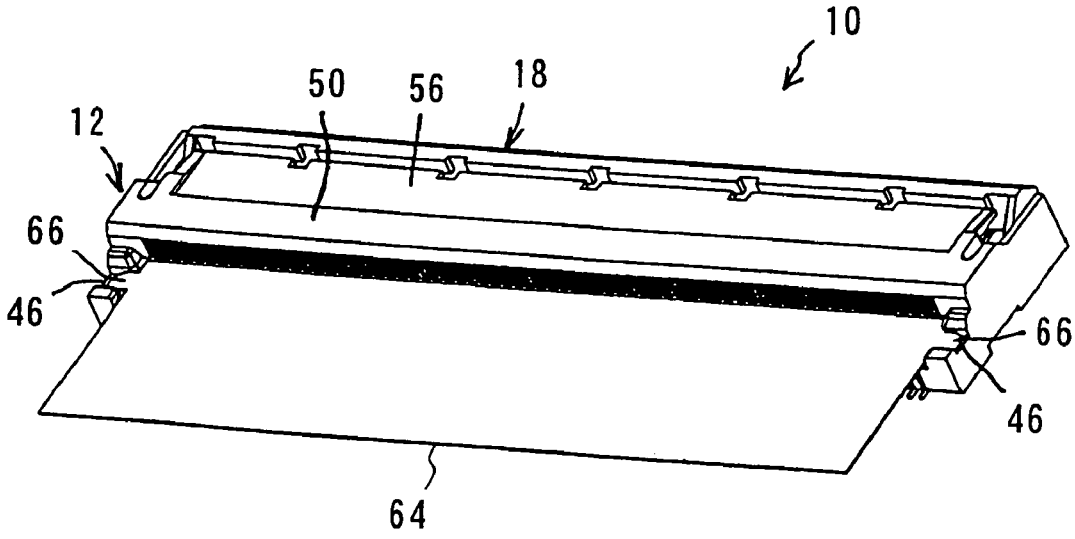
FIG. 7B is a perspective view of the connector with the flexible printed circuit board inserted.

One embodiment of the invention will be explained with reference to FIGS. 1A to 7B. FIG. 1A is a perspective view of a connector according to the invention with a pivoting member opened, viewed from the side of insertion of a flexible printed circuit board, while FIG. 1B is a perspective view of the connector shown in FIG. 1A with the pivoting member closed. FIG. 2 is a perspective view of the pivoting member, and FIG. 3 is a perspective view of the housing of the connector shown in FIG. 1A. FIG. 4A is a perspective view of a contact of one kind, while FIG. 4B is a perspective view of a contact of the other kind. FIG. 5A is a sectional view of the connector taken along the contact of the one kind with the pivoting member opened, while FIG. 5B is a sectional view of the connector similar to FIG. 5A with the pivoting member closed. FIG. 6A is a sectional view of the connector taken along the contact of the other kind with the pivoting member opened, while FIG. 6B is a sectional view of the connector similar to FIG. 6A with the pivoting member closed. FIG. 7A is a perspective view illustrating the connector and a flexible printed circuit board before being inserted into the connector, while FIG. 7B is a perspective view similar to FIG. 7A but after the flexible printed circuit board has been inserted in the connector.

The connector according to the one embodiment of the invention mainly comprises a housing 12, a pivoting member 18 and contacts 14 and 16. In the connector 10, two kinds of the contacts 14 and 16 are arranged alternately staggered by inserting these two kinds of the contacts into the housing 12 alternately in opposite directions. By changing alternately the directions of insertion to arrange the contacts staggered, the narrower pitches of contacts and miniaturization in height or reduced overall height can be achieved.

Before explaining the components of the connector, the flexible printed circuit board 64 will be explained. The flexible printed circuit board 64 mainly comprises contact portions adapted to be in contact with contact portions 26 of the contacts 14 and 16, patterns connected from the contact portions of the board 64 to circuits, and anchoring portions 66 adapted to engage engaging portions 46 of the housing 12. The contact portions of the flexible printed circuit board 64 in the embodiment are arranged alternately staggered. The shape of the anchoring portions 66 may be any shape so long as the anchoring portions 66 can engage the engaging portions 46 of the housing 12. In the embodiment, the shape of the anchoring portions 66 is in the form of a protrusion as shown in FIGS. 7A and 7B.

First, the contacts 14 and 16 of the two kinds will be explained with reference to FIGS. 4A and 4B. The contacts 14 and 16 of the two kinds are made of a metal and formed by means of the press-working of the known technique. Preferred metals from which to form these contacts include brass, beryllium copper, phosphor bronze and like which comply with the requirements such as springiness, electric conductivity and the like.

The contact of the one kind shown in FIG. 4A will be explained. The contact 14 is substantially in the form of "H" as shown in FIG. 4A and comprises a contact portion 26 (on the upper side in FIG. 4A) adapted to contact the flexible printed circuit board 64, a connection portion 40 adapted to be connected to a substrate or the like, a fixed portion 38 to be fixed to the housing 12, a connecting portion 30, a fulcrum portion 28, and a pressure receiving portion 32 adapted to be urged by the pivoting member 18. The contact portion 26 and the pressure receiving portion 32 are provided on both the ends of a first piece 22 of a substantially straight plate-shaped piece, respectively, and the pressure receiving portion 32 is provided at its front end with a projection 42 inwardly extending. The contact 14 further comprises a second piece 24 having a fulcrum portion 28 at one end and the connection portion 40 at the other end, and the fulcrum portion 28 and the first piece 22 are connected to each other by the connecting portion 30. The contact portion 26, the connecting portion 30, the fulcrum portion 28 and the connection portion 40 are arranged substantially in the form of a crank. Furthermore, the contact 14 comprises an extension portion 36 extending from the fulcrum portion 28 in such a direction that the extension portion 36 is opposite or facing to the contact portion 26, and an elastically displaceable contact piece 34 extending from the extension portion 36 substantially in the form of an "L-shape" in a position opposite or facing to the contact portion 26.

The position in which the connection portion 40 is arranged is suitably designed in consideration of positions of lands and patterns of a substrate and the little space. In other words, the connection portion 40 may be provided in a position opposite or facing to the contact portion 26 or the pressure receiving portion 32 depending upon customers demands or specifications. The connection portions 40 may be arranged alternately staggered according to the positions of the lands of the substrate. In the contact 14 of the one kind, the connection portion 40 is provided on the side opposite or facing to the pressure receiving portion 32. The contact portion 26 is protrusion-shaped to facilitate the contact with the flexible printed circuit board 64. Although the connection portion 40 is of a surface mounting type (SMT) as shown in FIG. 4A, it will be apparent that it may be of a dip type. According to the specification of a flexible printed circuit board 64, a further contact portion 26 may be provided on the side opposite or facing to the upper contact portion 26, thereby enabling the flexible printed circuit board 64 to be embraced between the contact portions 26. In this case, there are the opposed contact portions 26 on both the sides of the inserting direction of the flexible printed circuit board 64 so that the circuit board 64 is embraced by the contact portions 26 to securely bring the circuit board 64 into contact with the contacts. In the illustrated embodiment, the contact 14 of the one kind is provided with the extension portion 36 extending from the fulcrum portion 28 in such a direction that the extension portion 36 is opposite or facing to the contact portion 26, and the elastically displaceable contact piece 34 is provided on the extension portion 36 so as to extend substantially in the form of an "L-shape" in a position opposite or facing to the contact portion 26, and a contact portion 26 is provided at the front end of the contact piece 34, thereby enabling a flexible printed circuit board to be embraced between the contact portions 26. In the illustrated embodiment, the contact piece 34 is substantially in the form of the "L-shape", but it may be any shape insofar as it is elastically displaceable. For example, the contact piece may be of a shape of a beam supported at its both ends, or otherwise inverted L-shape which is different from that shown in this illustrated embodiment. Size and shape of the contact piece 34 may be suitably designed in consideration of the stable connection with the flexible printed circuit board 64 and strength of the contact piece 34.

The fulcrum portion 28, the connecting portion 30 and the pressure receiving portion 32 perform the following functions when the flexible printed circuit board 64 has been inserted. After the circuit board 64 has been inserted into the fitting opening 20 of the housing 12, the pivoting member 18 is pivotally moved to cause its urging portions 54 to be pivotally moved between the connection portions 40 and the pressure receiving portions 32 of the contacts 14 so that the pressure receiving portions 32 are raised by the urging portions 54, with the result that the connecting portions 30 of the contacts 14 are tilted about the fulcrum portions 28 toward the contact portions 26, thereby pressing the contact portions 26 against the flexible printed circuit board 64. Sizes and shapes of the fulcrum portions 28, the connecting portions 30 and the pressure receiving portions 32 are suitably designed so as to perform their functions. Moreover, the pressure receiving portion 32 of each of the contacts 14 is preferably provided at its front end with a projection 42. When the urging portions 54 of the pivoting member 18 are pivotally moved between the pressure receiving portions 32 and the connection portions 40 of the contacts 14, the projections 42 are caused to engage anchoring holes 58 of the pivoting member 18, thereby preventing the center portion of the pivoting member 18 from being deformed in the direction shown by an arrow B in FIG. 1B owing to the reaction against the pivotal movement of the pivoting member 18. The size of the projections 46 may be any size so long as the projections 46 can perform the function and may be suitably designed to be able to engage the anchoring holes 58 of the pivoting member 18.

In the embodiment, moreover, the connection portion 40 is provided with a protrusion base 44 extending toward the pressure receiving portion 32 so that the urging portions 54 of the pivoting member 18 are pivotally moved between the protrusion bases 44 and the pressure receiving portions 32 of the contacts 14. The protrusion base 44 serves to adjust a clearance between the pressure receiving portion 32 and the connection portion 40, in order to achieve a stable pivotal movement of the urging portion 54 of the pivoting member 18. The distance to which the protrusion base 44 extends may be suitably designed in consideration of such a function of the protrusion base 44.

Then, the contacts 16 of the other kind will be explained. Differences between the contacts 16 and 14 only will be explained here. Likewise, the contact 16 of the other kind is substantially in the form of "H" as shown in FIG. 4B and mainly comprises a contact portion 26 (on the upper portion of the contact 16 viewed in FIG. 4B) adapted to contact the flexible printed circuit board 64, a connection portion 40 adapted to be connected to a substrate, a fixed portion 38 to be fixed to the housing 12, a connecting portion 30, a fulcrum portion 28, and a pressure receiving portion 32 adapted to be urged by the pivoting member 18. The contact portion 26, the connecting portion 30, the fulcrum portion 28 and the connection portion 40 are arranged substantially in the form of a U-shape. Although the connection portion 40 of the contact 16 is of a surface mounting type (SMT) similarly to the contact 14, it will be apparent that it may be of a dip type.

The great difference between the contact 14 of the one kind and the contact 16 of the other kind lies in the fact that the positions of the connection portions 40 and the extension portions 36 are inverted, although there are slight differences in shape. In other words, in the contact 14 of the one kind, the connection portion 40 is located on the side opposite or facing to the pressure receiving portion 32 and the extension portion 36 is located on the side opposite or facing to the contact portion 26, while in the contact 16 of the other kind, the connection portion 40 is arranged to be opposite or facing to the contact portion 26 and the extension portion 36 is arranged to be opposite or facing to the pressure receiving portion 32. In the illustrated embodiment, similarly to the contact 14 of the one kind, between the fulcrum portion 28 and the connection portion 40 of the contact 16 of the other kind, there is provided an elastically displaceable contact piece 34 extending in the form of an "L-shape" in a position opposite or facing to the contact portion 26, and a contact portion 26 is also provided at the front end of the contact piece 34, thereby enabling a flexible printed circuit board to be embraced between the contact portions 26.

While the contacts 14 and 16 are shown substantially in the form of "H-shape" in the illustrated embodiment, it is to be understood that the contacts 14 of the one kind may be modified into a substantially "h-shape" (not shown) by removing the extension portion 36 extending from the fulcrum portion 28. Likewise, the contacts 16 of the other kind may be modified into a substantially "h-shape" (not shown) by removing the extension portion 36 extending from the fulcrum portion 28.

Movement and pivotal movement of the urging portions 54 of the pivoting member 18 will be explained here. Although the pivoting member 18 has a plurality of urging portions 54 in a row, the movement of the single urging portion will be explained for the sake of simplicity.

First, when the connecting object such as a flexible printed circuit board is not connected to the connector 10, the lower end (the right end viewed in FIG. 5A) of the urging portions 54 is positioned between the projection 42 of the pressure receiving portion 32 and the connection portion 40 or the housing 12.

Second, on pivotally moving (in clockwise direction viewed in the drawing) the actuating portion 56 of the pivoting member 18, the urging portion 54 is moved in a direction away from the fitting opening 20, and the lower end of the urging portion 54 is embraced by the projection 42 of the pressure receiving portion 32 and the connection portion 40 or the housing 12.

Third, on further pivotally moving the actuating portion 56 of the pivoting member 18, the urging portion 54 at the second position is pivotally moved about its center as a rotational axis.

Fourth, on further pivotally moving the actuating portion 56 of the pivoting member 18, the urging portion 54 at the third position is pivotally moved about the center of the urging portion as a rotational axis so that the urging portion 54 stands substantially upright between the pressure receiving portion 32 and the connection portion 40 or the housing 12, and the rotational axis is moved toward the upper end of the urging portion in contact with the projection 42.

Fifth, on further pivotally moving the actuating portion 56 of the pivoting member 18, the urging portion 54 at the fourth position is pivotally moved about a center in the proximity of the upper end of the urging portion in contact with the projection 42 as a rotational axis to cause the urging portion 54 to engage the projection 42.

In other words, the urging portion 54 is initially moved and then pivotally moved, and continuing with the pivotal movement of the pivoting member 18, the rotational axis is moved to achieve a compact and space-saving pivotal movement (rotation) of the urging portion 54. Namely, when a connecting object such as a flexible printed circuit board 64 is inserted into the connector 10 according to the invention, no large force is required because of the so-called "zero-insertion force (ZIF)" construction. The urging portions 54 of the pivoting member 18 are pivotally moved at a location nearer to the side of the projections 42 of the contacts 14 and 16 (or the pressure receiving portions 32 of the contacts 14 and 16 are raised at a location nearer to the projections 42) so that the pivoting member 18 can be locked with a smaller force. Moreover, the pressure receiving portions 32 of the contacts 14 and 16 are raised at a location nearer to the projections 42 so that higher contact force can be obtained between the contacts and the flexible printed circuit board.

The pivoting member 18 will then be explained. The pivoting member 18 is formed from an electrically insulating plastic material by means of the injection molding of the known technique. The materials suitable for the pivoting member 18 include polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The pivoting member 18 mainly comprises axles 63 adapted to be fitted in the housing 12 to permit the pivotal movement of the pivoting member 18 relative to the housing 12, urging portions 54 adapted to urge the pressure receiving portions 32 of the contacts 14 and 16, anchoring holes 58 with which the projections 42 of the contacts 14 and 16 are engaged, and an actuating portion 56 for pivotally moving the pivoting member 18 manually. The axles 63 form a fulcrum for the pivotal movement of the pivoting member 18 pivotally mounted on the housing 12 by means of the axles 63 fitted in longitudinal ends of the housing 12. The pivoting member 18 is further provided with locking portions 59 at its longitudinal ends, which are adapted to engage the housing 12 for preventing the pivoting member from being raised (upwardly viewed in the drawing) when the pressure receiving portions 22 of the contacts 14 and 16 are urged by the urging portions 54 of the pivoting member 18. The shape and size of the locking portions 59 may be any shape and size insofar as they can engage the housing 12 and may be suitably designed in consideration of the function described above and the size and strength of the connector 10.

The urging portions 54 of the pivoting member 18 serve to urge the pressure receiving portions 32 of the contacts 14 and 16 and are preferably of an elongated shape, particularly elliptical in the illustrated embodiment. With such an elliptical shape, when the pivoting member 16 is pivotally moved in the direction shown by an arrow A in FIG. 5A and an arrow C in FIG. 6A to rotate the urging portions 36 between the pressure receiving portions 32 and the connection portions 40 of the contacts 14 and 16 or the housing 12, the pressure receiving portions 32 of the contacts 14 and 16 are moved upwardly with variation in contacting height owing to the elliptical shape of the urging portions 54, thereby pressing the contact portions 26 of the contacts 14 and 16 against the flexible printed circuit board 64. The shape of the urging portions 54 may be any shape insofar as the urging portions 54 can be rotated between the pressure receiving portions 32 and the connection portions 40 of the contacts 14 and 16 or the housing 12, and the pressure receiving portions 32 of the contacts 14 and 16 can be raised with the aid of the difference in length, for example, between major and minor axes of an ellipse which is the cross-sectional shape of the urging portions of the pivoting member 18. The shape and size of the urging portions 54 may be suitably designed in consideration of such functions. The pivoting member 18 is provided with the actuating portion 56 in consideration of operationality.

Moreover, the pivoting member 18 is provided with anchoring holes 58 independent from one another with which the projections 42 of the contacts 14 and 16 are engaged for the purpose of preventing the center of the pivoting member 18 from being deformed in the direction shown by an arrow B in FIG. 1B owing to the strong reaction against the pivotal movement of the pivoting member 18. By providing the anchoring holes 58 independently from one another, the strength of the pivoting member 18 is increased, and the deformation of the pivoting member 18 is prevented when the pivoting member 18 is pivotally moved.

The pivoting member 18 constructed above described is pivotally mounted on the housing 12 on the opposite side of the fitting opening 20 (on the side of the connection portions of the contacts 14 of the one kind). Moreover, the pivoting member 18 is provided a groove 62 (FIGS. 5A and 6A) as an undercut for preventing the pivoting member from abutting against the upper wall 52 of the housing when the pivoting member 18 is pivotally moved relative to the housing 12.

Finally, the housing 12 will be explained. The housing 12 is formed from an electrically insulating plastic material by means of the injection molding of the known technique. The materials suitable for the housing 12 include polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The housing 12 is formed with inserting grooves 48 into which a required number of contacts 14 and 16 are inserted and fixed thereat by press-fitting, hooking (lancing), welding or the like, respectively. Moreover, the housing 12 is provided with a fitting opening 20 into which a flexible printed circuit board 64 is inserted. The size of the fitting opening may be suitably designed to permit the flexible printed circuit board 64 to be inserted. The inserted circuit board is securely urged against the contacts by the action of the pivoting member 18. The housing 12 is further provided with bearings at the longitudinal ends for receiving the axles 63 of the pivoting member 18 for its pivotal movement relative to the housing. The shape and size of the bearings may be any ones insofar as the axles 63 of the pivoting member 18 can be received to permit the pivotal movement of the pivoting member and may be suitably designed in consideration of their function and strength and size of the housing 12.

The housing 12 is provided with a ceiling portion 50 for covering the contact portions 26 of the contacts 14 and 16, and an upper wall 52 contiguously formed with the ceiling portion 50 for covering the pressure receiving portions 32 of the contacts 14 and 16. The ceiling portion 50 and the upper wall 52 serve to improve the dust proofing property for the contacts 14 and 16. Their sizes and shapes may be suitably designed in consideration of their functions, the strength of the housing 12 and the pivotal moving capability and the strength of the pivoting member 18 and the like.

Figure 8:
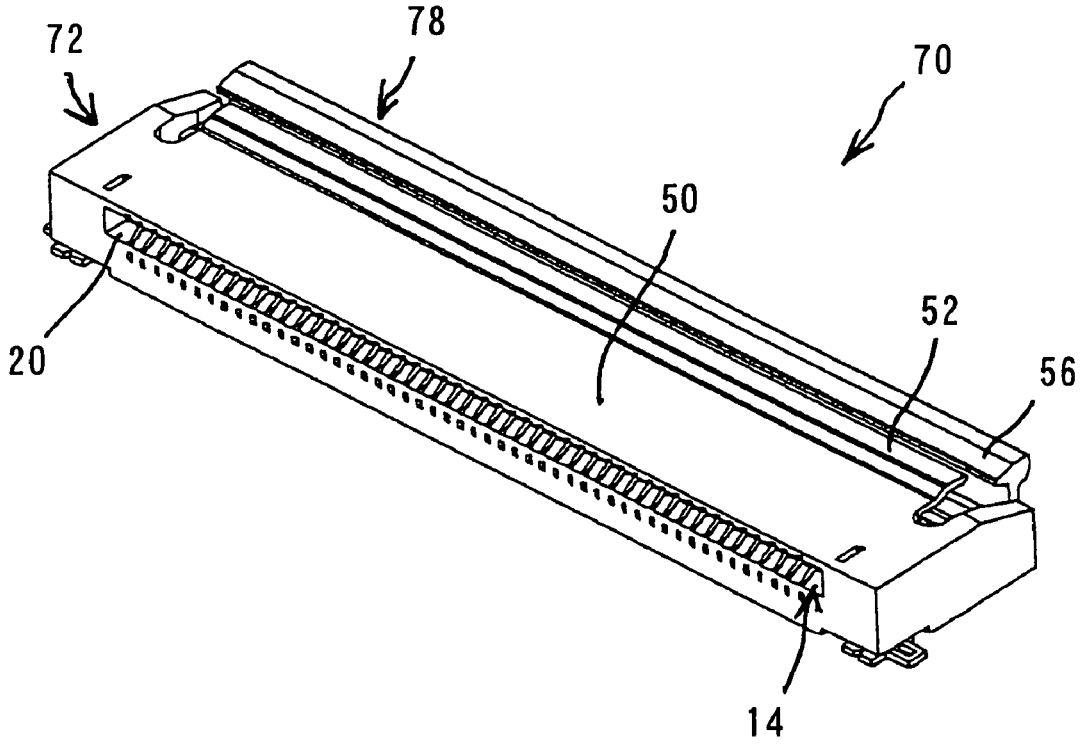
FIG. 8 is a perspective view of a connector with a pivoting member closed (connector being connected to a flexible printed circuit board) according to another embodiment of the invention.

Another embodiment of the invention will be explained with reference to FIG. 8. Differences from those described above only will be explained hereinafter. FIG. 8 is a perspective view of a connector of this embodiment with its pivoting member closed (a flexible printed circuit board being connected to the connector). Different features are shapes of parts of a housing 72 and a pivoting member 78. As is clearly evident from a comparison of FIG. 1B with FIG. 8, the housing 72 and the pivoting member 78 are completely free from recessed portions (grooves) for the purpose of improving the dust proofing property when a flexible printed circuit board 64 is connected to the connector. In other words, the forward end of the upper wall 52 of the housing 72 is free from slits, grooves, recesses, notches and the like so as to be as flat as possible as shown in FIG. 8. Moreover, the forward end of the actuating portion 56 of the pivoting member 78 is free from slits, grooves, recesses, notches and the like so as to be as flat as possible as shown in FIG. 8. In the embodiment in FIG. 8, the fitting opening 20 of the housing is covered with its upper portion because of the system that a flexible printed circuit board is inserted into the connector.

Examples of applications of the invention are connectors using a flexible printed circuit board for use in electric or electronic appliances such as thin type plasma displays or televisions, notebook personal computers and the like, particularly dust-proof connectors.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector detachably fitted with a connecting object such as a flexible printed circuit board, including a required number of contacts having a contact portion adapted to contact said connecting object, a housing holding and fixing said contacts and having a fitting opening into which said connecting object is inserted, and a pivoting member for urging said contacts, wherein said contacts each comprises a first piece having the contact portion at one end adapted to contact said connecting object, a pressure receiving portion at the other end adapted to be urged by said pivoting member, and a projection inwardly extending from the front end of said pressure receiving portion; a second piece having a fulcrum portion at one end and a connection portion at the other end adapted to be connected to a substrate; and a connecting portion for connecting said first piece and said fulcrum portion; and said contact portion, said connecting portion, said fulcrum portion and said connection portion are arranged substantially in the form of a crank, wherein said housing comprises a ceiling portion covering said contact portions of said contacts, and an upper wall covering said pressure receiving portions of the contacts and provided contiguous to said ceiling portion, wherein said pivoting member comprises an actuating portion for pivotally moving said pivoting member, urging portions provided continuously in its longitudinal direction, anchoring holes independently from one another for receiving said pressure receiving portions of the contacts and adapted to engage said projections, and a cover portion for covering vertical surfaces of tail portions of said contacts, and said pivoting member is so mounted on said housing that the urging portions are pivotally moved between the connection portions and the pressure receiving portions of the contacts, and wherein when the contacts have been connected to said connecting object by pivotally moving said pivoting member, the tail portions of said contacts are covered by said cover portion of the pivoting member.

2. The connector as set forth in claim 1, wherein said connecting object is provided with anchoring portions, and said housing is provided on both sides in its longitudinal direction with engaging portions each adapted to engage said anchoring portion of said connecting object.

3. The connector as set forth in claim 1, wherein said contacts are each provided with an extension portion extending from said fulcrum portion in such a direction that said extension portion faces to said contact portion, and further provided with an elastically displaceable contact piece extending substantially in the form of an L-shape from said extension portion in a position facing to said contact portion.

4. The connector as set forth in claim 3, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

5. The connector as ser forth in claim 3, wherein said pivoting member is provided with a groove for preventing the pivoting member from abutting against the upper wall of the housing when the pivoting member is pivotally moved relative to the housing.

6. The connector as set forth in claim 2, wherein said connecting object is provided with projections or recesses as said anchoring portions, and said housing is provided with recesses or projections as said engaging portions adapted to engage said anchoring portions.

7. The connector as set forth in claim 1, wherein said upper wall of the housing and said actuating portion of the pivoting member are free from slits, grooves, recesses, notches or the like so as to be as flat as possible.

8. The connector as set forth in claim 2, wherein said contacts are each provided with an extension portion extending from said fulcrum portion in such a direction that said extension portion faces to said contact portion, and further provided with an elastically displaceable contact piece extending substantially in the form of an L-shape from said extension portion in a position facing to said contact portion.

9. The connector as set forth in claim 2, wherein said contacts of the one kind are each provided with an extension portion extending from said fulcrum portion in such a direction that said extension portion faces to said contact portion and further provided with an elastically displaceable contact piece extending from said extension portion in a position facing to said contact portion, and said contacts of the other kind are each provided with an extension portion extending from the fulcrum portion onto such a side that the extension portion faces to the pressure receiving portion, and further provided with an elastically displaceable contact piece extending substantially in the form of an L-shape in a position facing to said contact portion between said fulcrum portion and said connection portion.

10. The connector as set forth in claim 8, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

11. The connector as set forth in claim 9, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

12. The connector as ser forth in claim 8, wherein said pivoting member is provided with a groove for preventing the pivoting member from abutting against the upper wall of the housing when the pivoting member is pivotally moved relative to the housing.

13. The connector as ser forth in claim 9, wherein said pivoting member is provided with a groove for preventing the pivoting member from abutting against the upper wall of the housing when the pivoting member is pivotally moved relative to the housing.

14. A connector detachably fitted with a connecting object such as a flexible printed circuit board, including a required number of contacts having a contact portion adapted to contact said connecting object, a housing holding and fixing said contacts and having a fitting opening into which said connecting object is inserted, and a pivoting member for urging said contacts, wherein said contacts comprise two kinds of contacts arranged alternately staggered, said contacts of one kind each comprises a first piece having the contact portion at one end adapted to contact said connecting object, a pressure receiving portion at the other end adapted to be urged by said pivoting member, and a projection inwardly extending from the front end of said pressure receiving portion; a second piece having a fulcrum portion at one end and a connection portion at the other end adapted to be connected to a substrate; and a connecting portion for connecting said first piece and said fulcrum portion; and said contact portion, said connecting portion, said fulcrum portion and said connection portion are arranged substantially in the form of a crank, and said contacts of the other kind each comprise a first piece having the contact portion at one end adapted to contact said connecting object, a pressure receiving portion at the other end adapted to be urged by said pivoting member, and a projection inwardly extending from the front end of said pressure receiving portion; a second piece having a connection portion at one end adapted to be connected to a substrate and a fulcrum portion at the other end; and a connecting portion for connecting said first piece and said fulcrum portion; and said contact portion, said connecting portion, said fulcrum portion and said connection portion are arranged substantially in the form of a U-shape, wherein said housing comprises a ceiling portion covering said contact portions of said contacts of the one kind and the other kind, and an upper wall covering said pressure receiving portions of the contacts of both the kinds and provided contiguous to said ceiling portion, wherein said pivoting member comprises an actuating portion for pivotally moving said pivoting member, urging portions provided continuously in its longitudinal direction, anchoring holes independently from one another for receiving said pressure receiving portions of the contacts and adapted to engage said projections, and a cover portion for covering vertical surfaces of tail portions of said contacts, and said pivoting member is so mounted on said housing that the urging portions are pivotally moved between the connection portions and the pressure receiving portions of the contacts of the one kind or between the pressure receiving portions of the contacts of the other kind and the housing, and wherein when the contacts have been connected to said connecting object by pivotally moving said pivoting member, the tail portions of said contacts are covered by said cover portion of the pivoting member.

15. The connector as set forth in claim 2, wherein said contacts of the one kind are each provided with an extension portion extending from said fulcrum portion in such a direction that said extension portion faces to said contact portion and further provided with an elastically displaceable contact piece extending from said extension portion in a position facing to said contact portion, and said contacts of the other kind are each provided with an extension portion extending from the fulcrum portion onto such a side that the extension portion faces to the pressure receiving portion, and further provided with an elastically displaceable contact piece extending substantially in the form of an L-shape in a position facing to said contact portion between said fulcrum portion and said connection portion.

16. The connector as set forth in claim 14, wherein said connecting object is provided with anchoring portions, and said housing is provided on both sides in its longitudinal direction with engaging portions each adapted to engage said anchoring portion of said connecting object.

17. The connector as set forth in claim 16, wherein said contacts are each provided with an extension portion extending from said fulcrum portion in such a direction that said extension portion faces to said contact portion, and further provided with an elastically displaceable contact piece extending substantially in the form of an L-shape from said extension portion in a position facing to said contact portion.

18. The connector as set forth in claim 16, wherein said contacts of the one kind are each provided with an extension portion extending from said fulcrum portion in such a direction that said extension portion faces to said contact portion and further provided with an elastically displaceable contact piece extending from said extension portion in a position facing to said contact portion, and said contacts of the other kind are each provided with an extension portion extending from the fulcrum portion onto such a side that the extension portion faces to the pressure receiving portion, and further provided with an elastically displaceable contact piece extending substantially in the form of an L-shape in a position facing to said contact portion between said fulcrum portion and said connection portion.

19. The connector as set forth in claim 15, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

20. The connector as set forth in claim 17, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

21. The connector as set forth in claim 18, wherein the connection portions of said contacts and said contacts of the one kind are each provided with a protrusion base extending from the connection portion, and when said pivoting member is pivotally moved, its urging portions are pivotally moved between the pressure receiving portions and the protrusion bases.

22. The connector as ser forth in claim 15, wherein said pivoting member is provided with a groove for preventing the pivoting member from abutting against the upper wall of the housing when the pivoting member is pivotally moved relative to the housing.

23. The connector as ser forth in claim 17, wherein said pivoting member is provided with a groove for preventing the pivoting member from abutting against the upper wall of the housing when the pivoting member is pivotally moved relative to the housing.

24. The connector as ser forth in claim 18, wherein said pivoting member is provided with a groove for preventing the pivoting member from abutting against the upper wall of the housing when the pivoting member is pivotally moved relative to the housing.

25. The connector as set forth in claim 16, wherein said connecting object is provided with projections or recesses as said anchoring portions, and said housing is provided with recesses or projections as said engaging portions adapted to engage said anchoring portions.

26. The connector as set forth in claim 14, wherein said upper wall of the housing and said actuating portion of the pivoting member are free from slits, grooves, recesses, notches or the like so as to be as flat as possible.

* * * * *